US005884333A

United States Patent [19]

Soliman

[11] Patent Number: 5,884,333

[45] Date of Patent: Mar. 23, 1999

[54] UNISEX NETSUKE ART NECK WEAR

[76] Inventor: Manal Daniel Soliman, 801 Kaufman Ave., Tahleqah, Okla. 74464

[21] Appl. No.: 924,818

[22] Filed: Sep. 5, 1997

[51] Int. Cl.[6] ..... A41D 25/00

[52] U.S. Cl. ..... 2/145; 2/148; 2/149; 2/156; 2/152.1; D2/607; 24/66.9; 24/66.11

[58] Field of Search ..... 2/145, 146, 147, 2/148, 149, 150, 151, 152.1, 153, 154, 155, 156, 157, 244, 246; D2/500, 501, 502, 605, 607, 609, 604; 24/49.1, 66.11, 66.12, 66.9

[56] References Cited

U.S. PATENT DOCUMENTS

| | | | |
|---|---|---|---|
| D. 182,767 | 5/1958 | Klitzner | D3/16 |
| D. 201,658 | 7/1965 | Waidelich | D3/16 |
| 400,218 | 3/1889 | Johnston | 2/246 |
| 1,323,977 | 12/1919 | Gaunt | 2/246 |
| 2,377,308 | 6/1945 | Brown | 2/246 |
| 2,570,378 | 10/1951 | Rinehart | D2/607 X |
| 3,187,396 | 6/1965 | Carroll | 24/66.11 |
| 3,364,500 | 1/1968 | Fox | 24/66.9 X |
| 4,885,805 | 12/1989 | Mason | 2/244 |
| 5,416,925 | 5/1995 | Davis | 2/144 |
| 5,493,731 | 2/1996 | Amnott | 2/152.1 |
| 5,765,227 | 6/1998 | Wright | 2/144 |

*Primary Examiner*—Jeanette Chapman
*Attorney, Agent, or Firm*—William S. Dorman

[57] ABSTRACT

Unisex Netsuke art neck wear provides a unique, elegant, affordable, durable and maintenance free neck wear in place of cloth necktie for use by men and women. The carved netsuke art object is made of a polymer or crushed marble. The simplicity of the double overhand or the triple overhand knot on the cord that keeps the carved netsuke art object against the shirt collar is a great feature. While being a very secure knot, it is also very simple and easy to tie and untie. The cord is made of silk or supple leather. Besides being a revival of centuries old art form, unisex netsuke art neck wear gives a dress-down appearance while assuring an elegant dressy look.

1 Claim, 3 Drawing Sheets

UNISEX NETSUKE ART NECK WEAR

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

FIELD OF INVENTION

This invention relate to a neckwear assembly and a method of using said neckwear assembly.

BACKGROUND OF THE INVENTION

Neck Wear Assembly And Method Of Using The Same, provides a new wearable item in place of a cloth necktie, to be used by men and women.

Netsuke is a carved and decorated wood or ivory art object that arose in the sixteenth century in Japan. It was used to carry a seal, tobacco, as a receptacle for aromatic herbs and medicine, and as a means to attach a pouch or a coin carrying purse to the traditional garment. By end of the nineteenth century the use of netsuke declined. This was due to the adoption of western dress which provides plenty of pockets, and the carrying of a pouch was replaced by the wallet.

A sailors knot, known as overhand knot, is used to secure the netsuke art object against the shirt collar.

BRIEF SUMMARY OF THE INVENTION

Unisex Netsuke Art Neck Wear provides an elegant, yet casual neck wear in place of a cloth necktie, for men and women. Netsuke art objects give a dress-down appearance, while providing an elegant and dressy look. It is a revival of four centuries old art form to a contemporary use as a neck wear. A cord, which is made of silk, rayon, or supple leather runs under the shirt collar. The free ends of the cord pass through two holes which are longitudinally drilled in the back aspect of the carved and decorated netsuke art object. Two matching beads are present at the tips of the two free ends of the cord, secured from slipping by a simple knot in the cord. The two free ends of the cord are tied together by means of a double overhand or a triple overhand knot, which secures the netsuke art object at the shirt collar. The overhand knot is used by sailors who handle ropes and cords during sailing. Besides being secure and easy to tie, the overhand knot is very easy to undo as well. By simply pulling down on either one of the free ends of the cord, due to its nature, the overhand knot comes loose. Unisex netsuke art neck wear is unique, elegant, durable, and functional. The carved and decorated netsuke art objects are made of a polymer or crushed marble. Consequently, they are affordable, and unlike cloth neck wear, there is no need for dry cleaning.

DETAILED DESCRIPTION OF THE INVENTION

Figure 1:
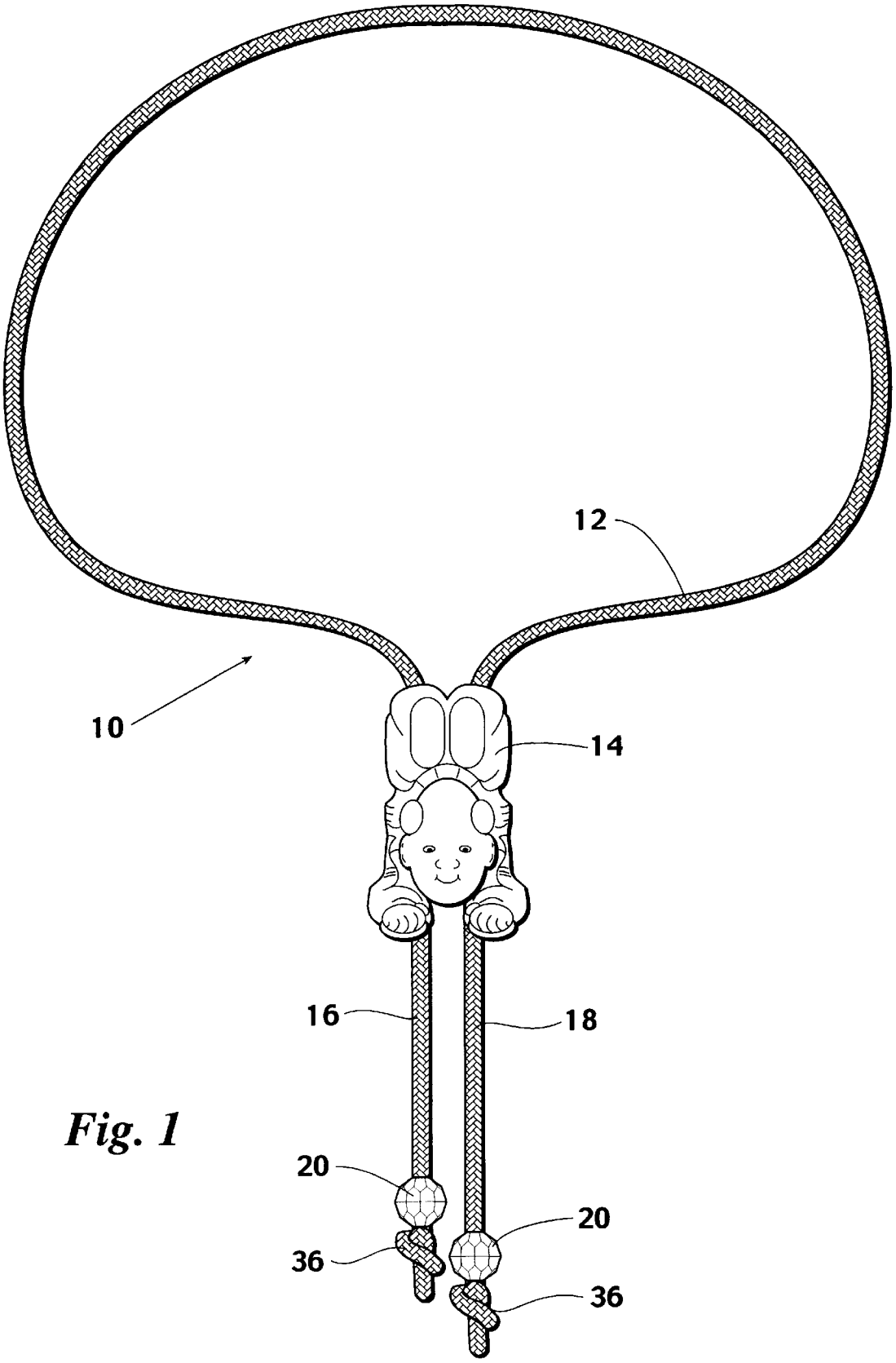
FIG. 1 is a front view of a preferred embodiment of my neckwear assembly, showing the cord passing through the art object with beads being located adjacent the lower ends of the cord.

Referring to the drawings in detail, FIG. 1 shows a neckwear assembly 10 comprising a cord 12 held together intermediate its ends by an art object 14 (later to be described). The cord 12 has two lower ends 16 and 18 adjacent the tips of which are received beads 20.

Figure 2:
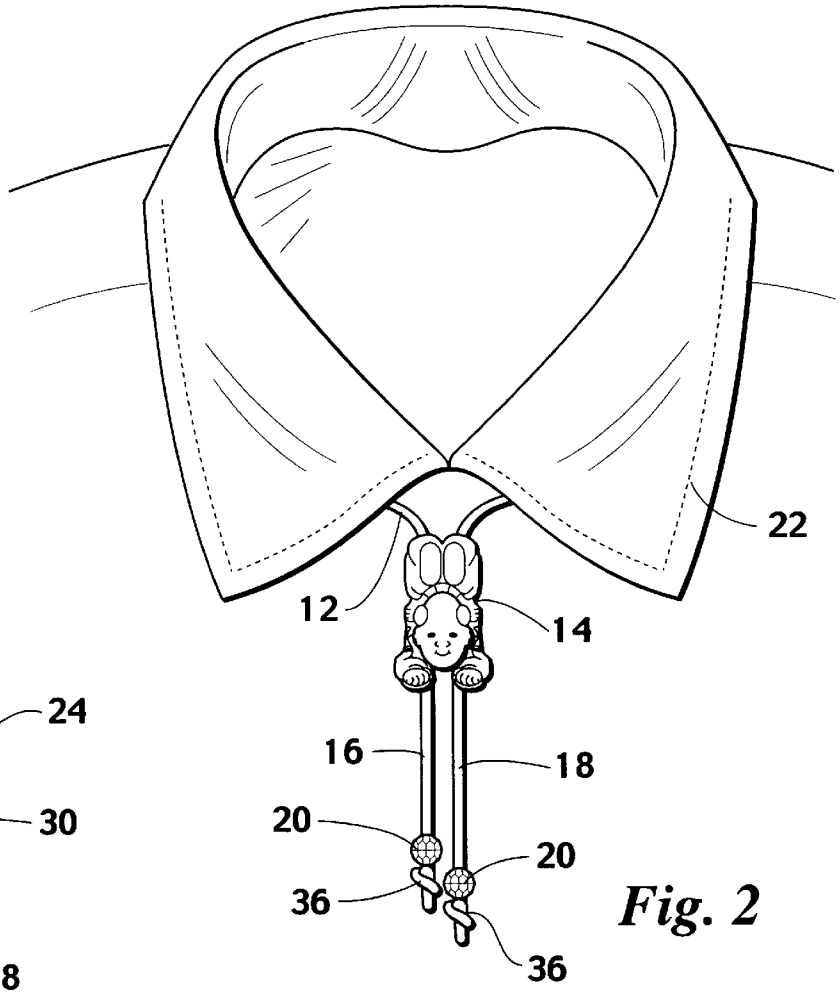
FIG. 2 is a view similar to FIG. 1, but showing the neckwear assembly in relation to the collar of a shirt.

The cord 12 can be made of silk, rayon, or supple leather and is adapted to encircle the neck of the wearer and preferably runs under a shirt collar 22, as best shown in FIG. 2.

Figure 4:
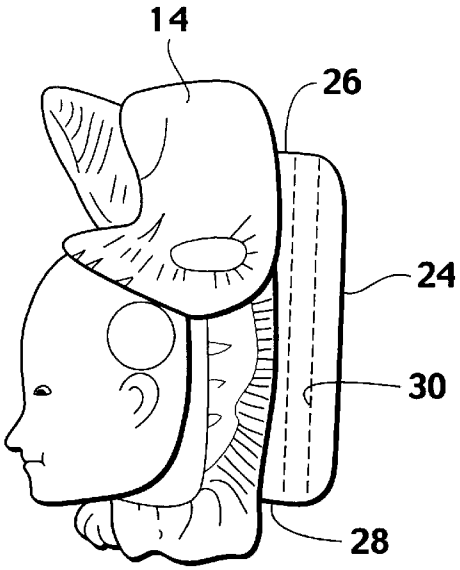
FIG. 4 is a side view taken from FIG. 3.
Figure 5:
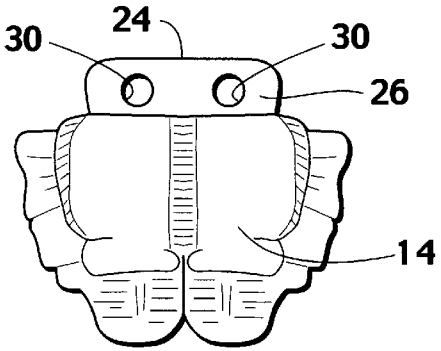
FIG. 5 is a top view taken from FIG. 3.
Figure 3:
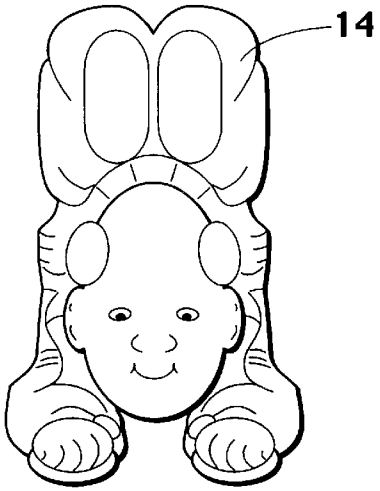
FIG. 3 is a plan view of the art object shown in FIGS. 1 and 2.

The Netsuke art object 14 is shown in FIGS. 3, 4, and 5. This art object 14 consists of a carved and decorated piece which can be made of a polymer or crushed marble. The art piece 14 is preferably made by a molding process, the details of which are not considered pertinent to this invention. After molding, the art piece or object 14 can be painted and/or decorated by hand to make the color and texture of the original 16th Century Art Pieces.

The art piece or object 14 is preferably about 3.5 cm. to 4 cm. long, 1.5 cm. to 3 cm. in width and 1.2 cm. to 2.5 cm. in thickness or depth.

The art object 14 is provided with a rectangular part 24. The rectangular part 24 is preferably 1.2 cm. wide and 0.5 cm. thick. Its length is preferably 1 cm. shorter than the longitudinal axis (height) of the art piece 14 itself. Because the rectangular part 24 in the back of the piece is smaller in size than the front in all of its dimensions, the rectangular piece will not be visible when one looks at the front of the art object.

Because the rectangular part 24 is 1 cm. shorter than the length of the art object itself, there will be provided an upper shoulder 26 and a lower shoulder 28 as best seen in FIG. 4. For the same reason, when the knot (later to be described) is tied at the bottom 28 of the piece, the knot will not be visible as well.

The rectangular part 24 is further provided with two drilled holes 30 which pass from the top of the rectangular member 24 to the bottom thereof. The holes 30 are 0.3 cm. in diameter. The two free ends 16 and 18 of the cord 12 are adapted to pass through the two holes from the top downward to the bottom of the piece.

The beads 20, shown in FIG. 1, are ovoid in shape as shown: however, they could be cylindrical or round in shape. The beads can also be colored to match the color and texture of the art object 14 itself. The beads can be made of glass or semi-precious stone to have a heavier weight. Each of the beads 20 has a 0.3 cm. hole through the center thereof for the cord 12 to pass therethrough. In addition to serving a decorative function, the beads 20 facilitate the tying of the knot as will hereinafter appear. The location of the beads 20 at the tips of the cord ends 16 and 18 represent a sizable mass to hold while the knot is being tied. The beads also keep the free ends of the cord 12 streamlined. Most importantly, by their weight, the beads 20 exert a downward pull which is being continuously transmitted to the knot which functions to keep the knot secure.

The total length of the cord 12 is preferably 80 to 100 cm. to suit the height or size of the person wearing the netsuke art wear 10. As indicated previously, the cord 12 is preferable made of silk, rayon or supple leather and is round in shape with a diameter equal to or slightly less than 0.3. cm. The cord 12 is preferably placed around the neck behind the shirt collar 22. The two free ends 16 and 18 of the cord 12 are passed through the holes 30 in the rectangular part 24 as mentioned earlier. The two beads are located at the tips of the free ends 16 and 18 and are secured from slipping by means of two simple knots 36 near the ends of the tips of the cord.

Figure 7:
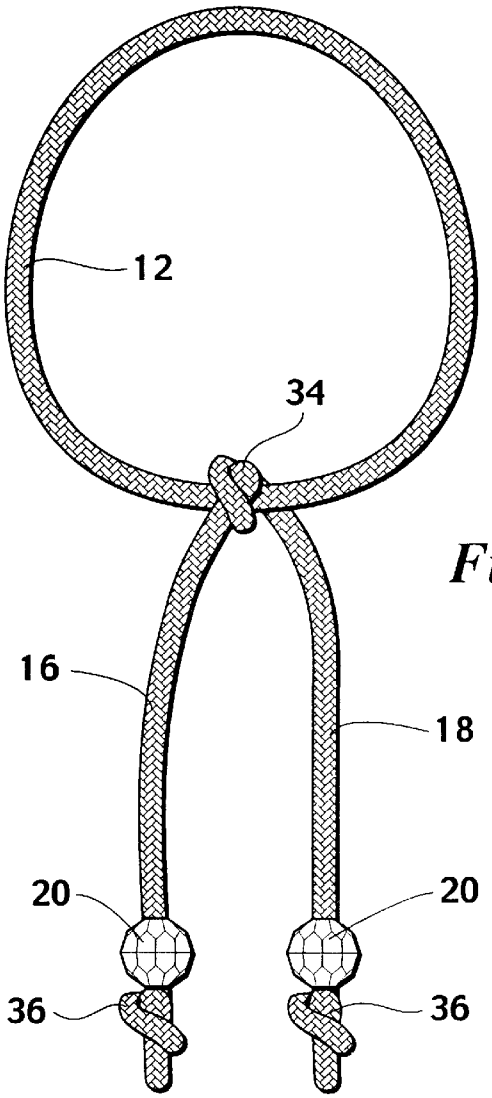
FIG. 7 is a view similar to FIG. 6, but showing the same knot in a tightly secured condition as would occur by a downward pull on the to free ends of the cord.
Figure 6:
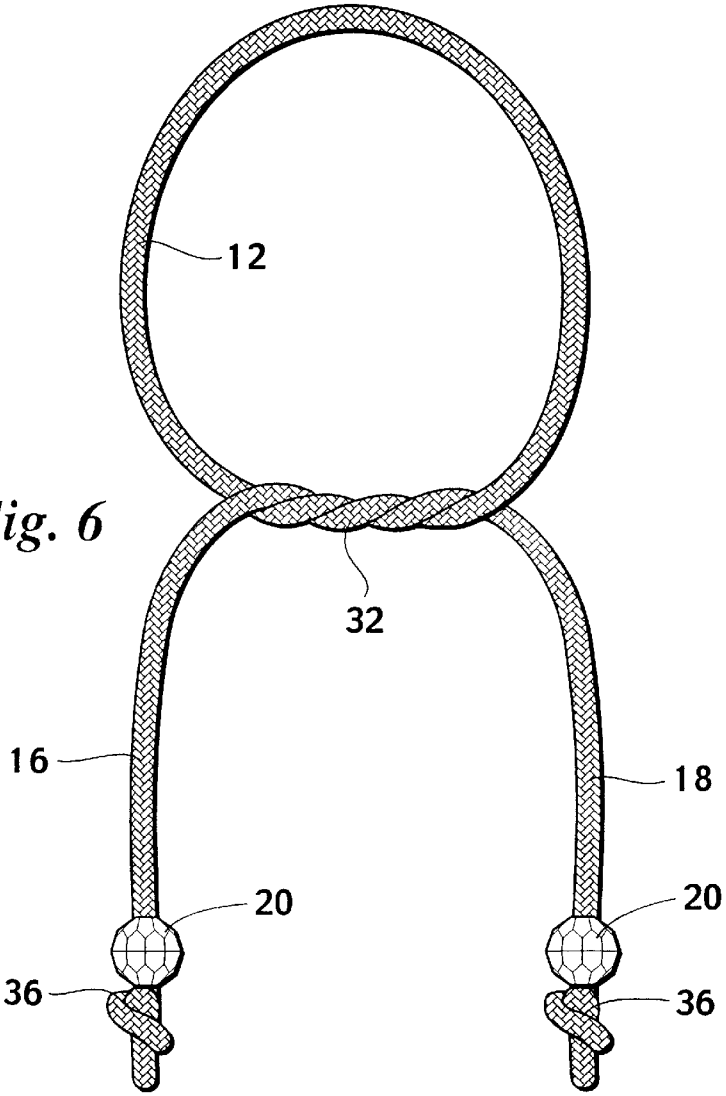
FIG. 6 is a diagrammatic representation of the cord of FIG. 1 showing a loosely tied double overhand knot.

A knot 32 is made using the two free ends 16 and 18 of the cord to secure the netsuke art object 14 against a shirt collar 22 as shown in FIG. 2. The knot 32 shown in FIG. 6 is a double overhand knot, although a triple overhand knot could be used as well. Overhand knots are familiar to sailors who use them frequently, when handling ropes and cords during sailing. Sailors use the overhand knot for three reasons: it is a secure knot, it is easy to tie and it is easy to untie. FIG. 6 represents two passes of one free end 18 of the cord over the free end 16 together in a consecutive manner to make the double overhand knot. FIG. 7 shows the same knot transformed to the condition shown at 34 by exerting a gentle downward pull or tug on both free ends 16 and 18 of the cord. After the passes are made, a gentle downward pull or tug on both free ends 16 and 18 of the cord will secure the knot 34; at the same time this knot will become bunched up together and reduced in size. The knot 34 will be positioned beneath the lower shoulder 28 on the rectangular portion 24. To untie the knot all that is needed is to pull down on only one of the free ends of the cord and the knot becomes loose.

When tied, the double overhand (or triple overhand) knot secures the unisex art neck wear 10 against the shirt collar 22 as best shown in FIG. 2.

I claim:

1. A neck wear assembly comprising a cord adapted to encircle the neck of a wearer and having two free ends, an art object adapted to be received on the free ends of the cord, the art object having a front portion, a rear portion, a top portion, a bottom portion and side portions, the art object having a rectangular portion on the rear the portion thereof, the rectangular portion having a top, bottom, sides and a rear, the rectangular portion being of less width and length as the art object itself, said rectangular portion having a pair of holes extending therethrough from the top to the bottom of the rectangular portion, the free ends of the cord being adapted to pass through the holes from the top downward to the bottom of the rectangular portion and below, the free ends of the cord being further provided with weighted beads whereby an overhand knot can be provided in the cord by passing one free end of the cord over the other free end in a plurality of passes and in a consecutive manner to make said overhand knot, and whereby a gentle downward pull on both free ends of the cord will produce a knot which is bunched up and reduced in size beneath the bottom of the rectangular portion.

* * * * *